United States Patent [19]

Manjot

[11] 4,411,368

[45] Oct. 25, 1983

[54] SAFETY SYSTEM FOR HYDRAULICALLY CONTROLLED HOISTING APPARATUS

[76] Inventor: Roger Manjot, La Jonquière de Maupas, Marennes (Rhône), France

[21] Appl. No.: 241,664

[22] Filed: Mar. 9, 1981

[30] Foreign Application Priority Data

Mar. 21, 1980 [FR] France ..... 80 07238
Jun. 6, 1980 [FR] France ..... 80 13018

[51] Int. Cl.[3] ..... B66C 13/48
[52] U.S. Cl. ..... 212/149
[58] Field of Search ..... 212/149–153, 212/155

[56] References Cited

U.S. PATENT DOCUMENTS 3,854,593 12/1974 Gross ..... 212/150
3,963,127 6/1976 Eriksson ..... 212/149
4,027,772 6/1977 Garber ..... 212/149
4,170,308 10/1979 Rogers ..... 212/149

*Primary Examiner*—Trygve M. Blix
*Assistant Examiner*—Jesús D. Sotelo
*Attorney, Agent, or Firm*—Karl F. Ross; Herbert Dubno

[57] ABSTRACT

In this device, with each jack there is associated a pressure detection system comprising two thresholds, the upper one corresponding to the maximum pressure permitted, this double detection making it possible to determine the change in the pressure during the carrying out of a movement, after passage of the first threshold.

4 Claims, 8 Drawing Figures

SAFETY SYSTEM FOR HYDRAULICALLY CONTROLLED HOISTING APPARATUS

FIELD OF THE INVENTION

The present invention relates to a safety system for a hydraulically controlled hoisting apparatus.

BACKGROUND OF THE INVENTION

Apparatus of this type consists, for instance, of a hydraulic crane comprising a base column to which there is articulated a first arm to whose other end a telescopic second arm is articulated. It is important to have at all times information concerning the position of the point of application of the load at the end of the telescopic arm relative to two horizontal planes containing the pivot axis of the first arm on the base column and the pivot axis of the telescopic arm on the first arm respectively.

While it is necessary to know the direction of displacement of the first and second jack rods which make it possible to vary the angle formed between the base column and the first arm and the angle formed between the first arm and the second arm respectively, it is also important to know the effects resulting from these displacements.

As a matter of face, if the point of application of the load is located above the two planes and the maximum force tolerated is reached by emergence of the telescopic second arm, the return of the rods of the first and second jacks so as to permit a lowering of the load will correspond to an increase in the force, generating unacceptable pressures in these jacks. It is therefore advisable to prevent these return movements of the rods. On the other hand, if the emergence of the rods of the first and second jacks is started from this position, a decrease in the pressure takes place. It is therefore desirable that this movement be possible since it has no dangerous implication.

If a point of application of the load at the end of the telescopic arm is located below the two planes and if a limit value is reached by emergence of the telescopic arm, the emergence of the first and second rods will correspond to an increase of the pressure in the jacks which, if it reaches the limit of a permissible value, must be prevented.

To the extent that the point of application of the load is located between the planes, the emergence of the rod of the first jack must be possible since it corresponds to a decrease in the force, but the emergence of the rod of the second jack, corresponding to an increase of the torque, must be possible only if the pressure in the first and second jacks does not exceed the permitted value.

SUMMARY OF THE INVENTION

For this purpose, in the device according to the invention, each jack which permits the angular variation of two arms is equipped with a pressure detection device having two thresholds, each one detecting the highest pressure corresponding to its permitted limit pressure, the control means of the jacks being such that:

When a pressure corresponding to the first threshold is reached by an increase of the angle formed by the two arms of the apparatus, the continuation of the movement is prevented as well as the emergence of the telescope arm, and when a pressure corresponding to the first threshold is reached without modification of the angles which the different arms form but by elongation of a telescopic part which one of them comprises, the further emergence of the telescope is made impossible as well as the return of the rods of the jacks, which would correspond to a decrease in the respective angles formed by the different arms, the emergence only of the rods of these jacks now being possible, with the increase of the angles formed by the different arms being effected to the extent that the second threshold is not reached, while if the second threshold is reached, the emergence of the telescopic arm remains impossible and the emergence of the articulation jack rods of the arms is also made impossible while their return is permitted.

Due to the second pressure threshold being detected, this arrangement makes it possible to note the position of the point of application of the load by the interpretation of the effects resulting from the change in position of this point of application of load with respect to the two planes H1 and H2, of which the plane H1 is fixed and the plane H2 is variable in height.

Advantageously the pressure detection device associated with each jack which permits angular variation of two arms is formed of a pressure contact comprising two pressure detection thresholds.

In accordance with another embodiment of the invention, the pressure detection device associated with each jack permitting the angular variation of two arms is formed by two pressure contacts mounted in series, each of which has a given pressure detection threshold.

The effects of the detection device may take place either by actuation on each distributor in a direction opposite that which caused the reaching of a dangerous pressure or by actuation of a solenoid valve mounted on the safety circuit of the hydraulic system.

BRIEF DESCRIPTION OF THE DRAWING

The above features and advantages of the invention will be better understood from the following description with reference to the accompanying diagrammatic drawing which by way of illustration and not of limitation shows several embodiments of the invention in which.

SPECIFIC DESCRIPTION

Figure 1:
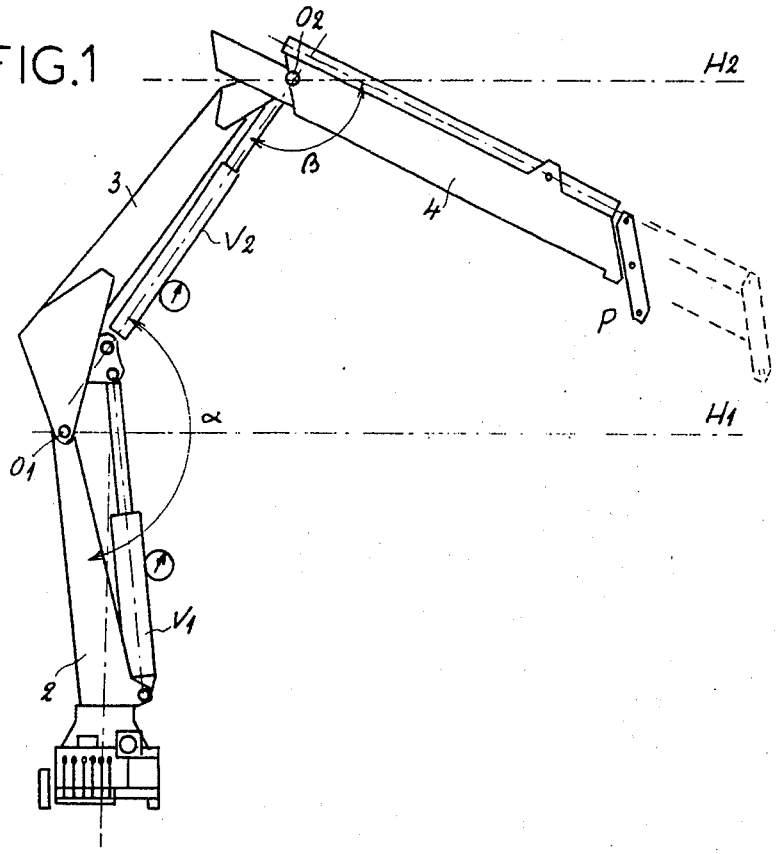
FIG. 1 is an elevational view of a crane according to the invention, intended to be mounted on a vehicle.

In the position shown in FIG. 1, the end of the telescopic arm 4 of the crane bears a load P. This position, obtained by an increase of the angles $\alpha$ and $\beta$ formed by the column 2 and the arm 3 and by the telescopic arm 4 respectively, does not result in a critical state.

To the extent that the emergence of the telescopic arm 4 is effected in order to bring it into the position shown in dashed lines in the drawing, the first pressure threshold is reached in one of the jacks $V_1$ or $V_2$. This reaching of the first threshold blocks the return of the rods of the jacks $V_1$ and $V_2$ as well as the further emergence of the telescopic arm 4. It is now impossible for the load to descend. If this were otherwise, then upon the taking on of a load at a height and during the lowering thereof exceeding of the capacity of the apparatus would occur.

If, starting from the position shown in dashed lines FIG. 1, one continues the lifting of the load by the jack $V_1$, the force on the jacks is decreased and further use of the apparatus is possible.

If one continues the ascent by emergence of the rod of the jack $V_2$, the increase in pressure will no longer have an effect on the initial safety system released by the reaching of the first threshold. There then enters into play the use of the second threshold which notes the value of the growth of the pressure which is increasing, since the point of application of the load is below the plane H2. If this displacement of the load by the increase of the angle $\beta$ produces a pressure corresponding to the second threshold which is at the level of a detector 10 or 12, the latter will cancel out the effects initiated by the first threshold, prevent the continuation of the ascent and permit only the descent, the emergence of the telescopic arm 4 remaining, of course, impossible.

Figure 2:
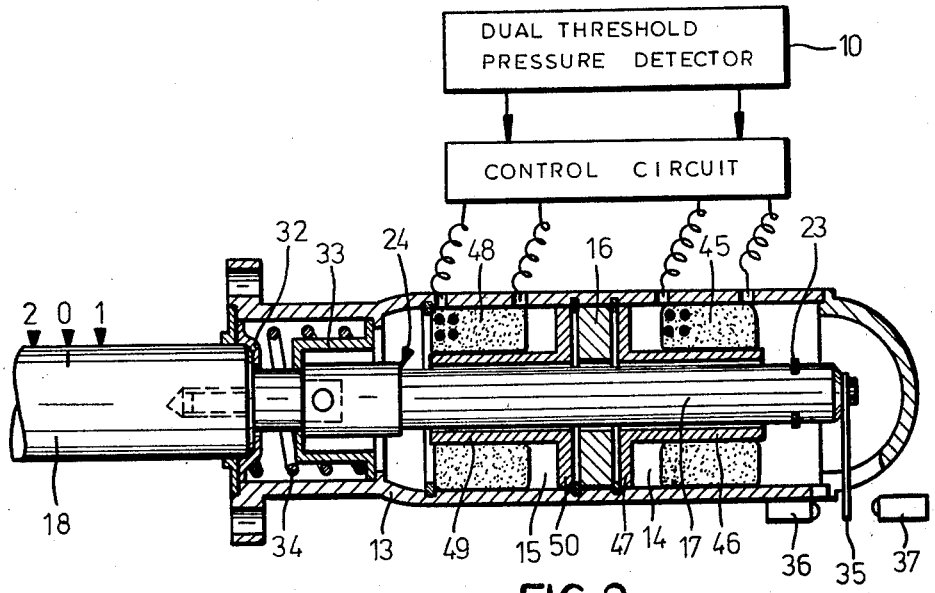
FIGS. 2 to 4 are three views in longitudinal section of a first device associated with the control distributor of each jack during three operating phases.
Figure 3:
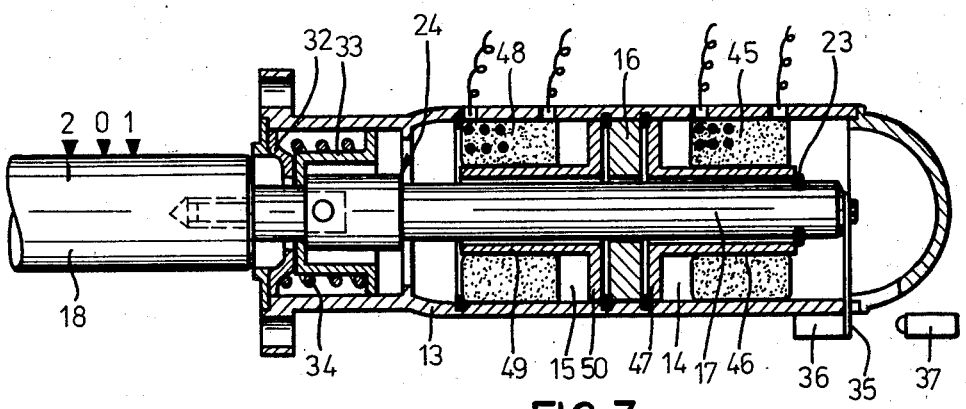
Figure 4:
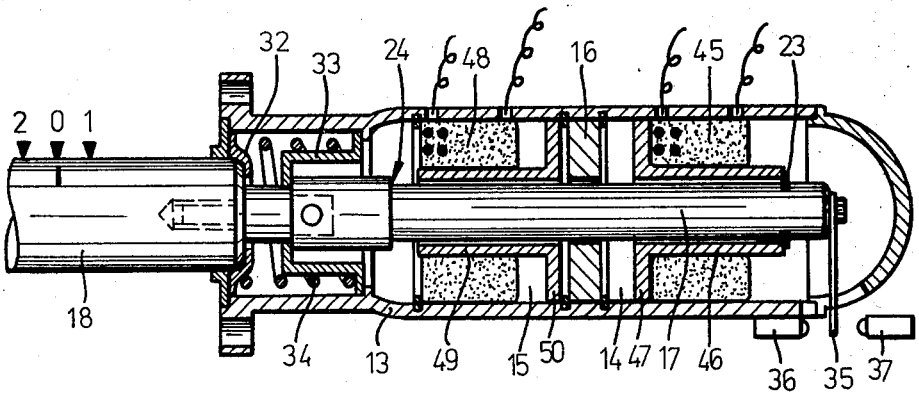

As shown in FIGS. 2 to 4, with each of the distributors, which are standard hydraulic slide distributors and therefore not illustrated, there is associated a solenoid device comprising a cylinder 13 separated into two chambers 14 and 15 by a central partition 16. Within the cylinder 13 there is mounted for axial displacement a rod 17 which is integral in movement with the end 18 of the slide of the control distributor concerned.

The displacement of the rod 17 must be able to be effected in both directions from the neutral position (0) of the slide of the distributor towards the positions of use (1) and (2). At the end farthest from the distributor, the rod 17 bears a stop formed by a circlip 23 while at the end closest to the distributor it has a stop formed by a shoulder 24.

With the rod 17 there are associated two small collars, namely 32, at the end of cylinder 13, and 33, inwardly thereof. Each of these collars is mounted in a slideable manner on the rod 17 and rests against a stop provided at the end of cylinder 13 for the collar 32 and a stop formed inside of the cylinder 13 for the collar 33. Each of the two collars 32 and 33 are therefore driven along by the rod 17 only in a single direction and in the direction of the other collar. Between the collars 32 and 33 there is mounted a coil spring 34 which assures the return and the holding of the rod 17 in a neutral position of the slide of the distributor.

To the end of the rod 17 opposite that connected to the slide of the distributor there is fastened a pawl 35 which is capable, as a function of the direction in which the rod is displaced, of actuating a contact 36 or 37.

Within the chamber 14 of the cylinder 13 there is permanently mounted the coil 45 of an electromagnet with which there is associated a tubular core 46 adapted to slide freely on the rod 17. The mounting is effected in such a manner that when the coil 45 is not activated, the slide 18 of the distributor can be maneuvered freely from the position (0) to the position (2) as shown in FIG. 3. During the course of this movement, the stop formed by the circlip 23 comes against the core 46. If the pressure in the jack being monitored reaches a dangerous value, the coil 45 is activated by a dual threshold pressure detector 10 and displaces the tubular core 46 and therefore the rod 17 and the slide of the distributor towards the right, returning the slide of the distributor to position (0) as shown in FIG. 4. The displacement of the core 46 is obtained by the magnetic effect on a flange portion thereof forming a collar 47 against the coil, the collar 47 being located between the central partition 16 and the coil 45.

Within the chamber 15 of the cylinder 13 there is mounted a coil 48, also activated by detector 10, with which there is associated a tubular core 49 comprising a collar 50 located between the coil 48 and the central partition 16, the displacement of the core taking place from right to left and acting on the rod 17 by pushing against the shoulder 24 to return the slide of the distributor 18 to the position (0) after the pressure in the monitored jack has reached a dangerous value and activated the distributor into position (1).

As is evident from the foregoing, the invention provides a substantial improvement in the existing art by providing a safety device of simple design which permits direct use of electrical information without transfer to a hydraulic circuit.

Figure 5:
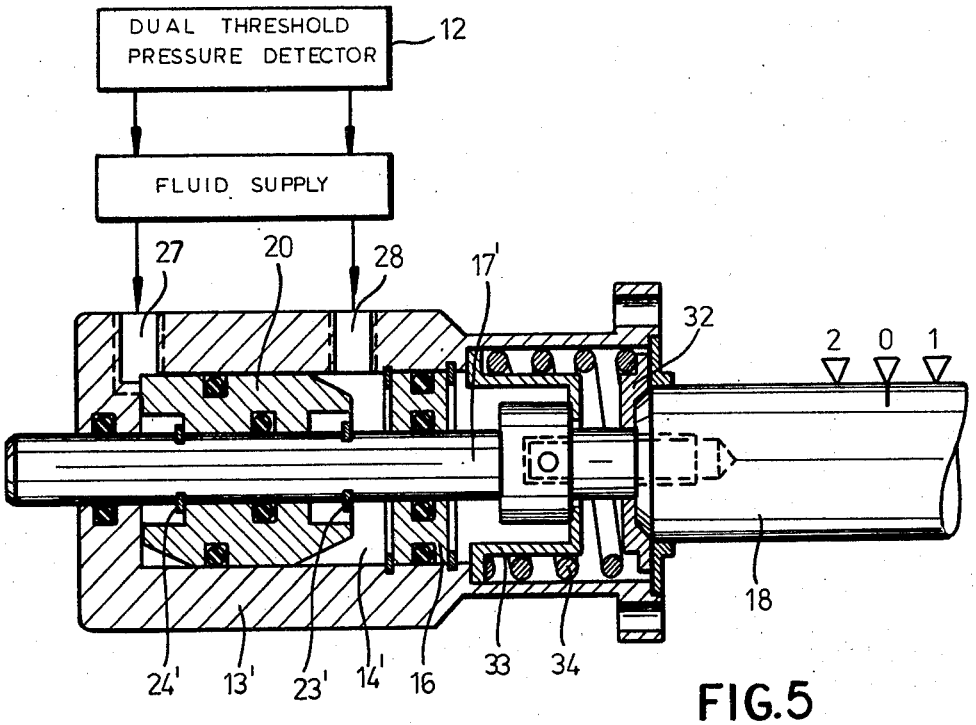
FIGS. 5 and 6 are two views in longitudinal section of another device associated with the control distributor of each jack, in two extreme positions.

In accordance with a variant of the means for the return of the control distributor of each jack to the (0) position, shown in FIG. 5, the cylinder 13 comprises a single chamber 14' near the two ends of which hydraulic fluid inlet openings 27 and 28 are provided. This chamber contains a double acting piston 20 provided with a seal and activated by the dual threshold pressure detector 12 and, mounted in a floating fashion capable of sliding both relative to the cylinder and relative to the rod 17' associated with the slide 18 of the distributor. On the rod 17' there are mounted circlips 23' and 24' which can cooperate with the opposite faces of the piston 20 to bring the slide of the distributor from the position (2) to the position (0) and from the position (1) to the position (0) respectively.

This arrangement simplifies the manufacture of the safety device by decreasing the number of moving parts as well as its size.

Figure 6:
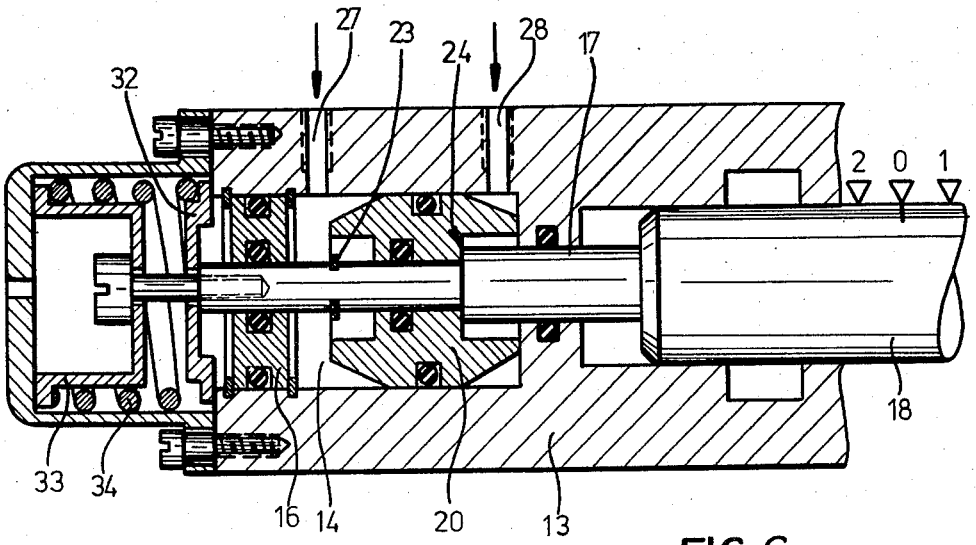

In accordance with another possibility shown in FIG. 6, the system for the elastic holding of the slide of the distributor in a neutral position (i.e. the spring) is located on the other side of the device relative to the slide of the distributor.

This arrangement is of interest since it further decreases the number of parts and permits the construction of the safety device at the same time as that of the distributor body. Due to the fact that the boreholes are perfectly coaxial in the body of the distributor and in the safety device, it is possible to avoid a universal joint between the slide of the distributor and the rod 17''.

Figure 7:
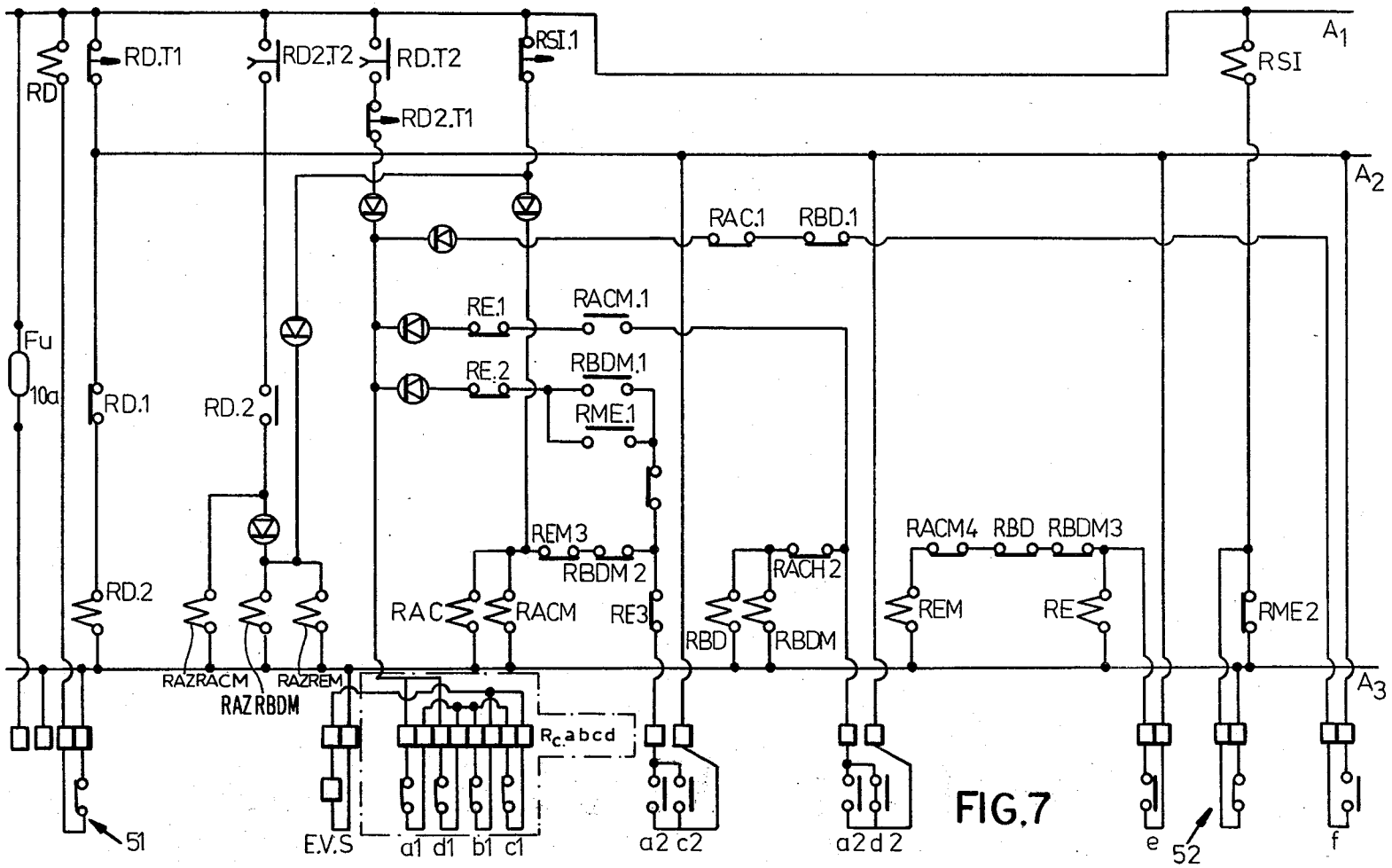
FIG. 7 is a schematic view of the electric control circuit of the safety system, with action on a solenoid valve of the safety system.

The electrical diagram shown in FIG. 7 comprises two feed lines A1, A2 and a return line A3. This electrical circuit feeds in particular a solenoid valve EVS as well as pressure detectors 10 or 12 having two thresholds marked 51 and 52 respectively.

Figure 8:
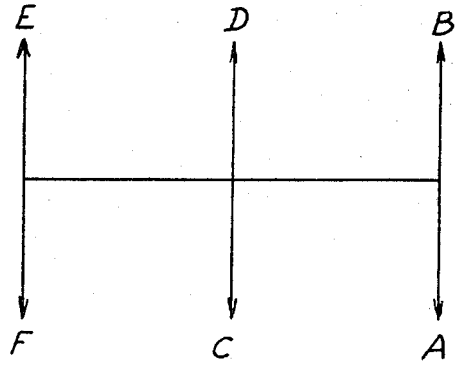
FIG. 8 is a diagram showing the various possibilities of actuation of a distributor associated with a crane in accordance with FIG. 1.

The different movements of the distributor shown diagrammatically in FIG. 8 bear the reference A for the emergence of the rod of the jack V1, B for the return of the rod of this same jack, and C and D for the emergence and return respectively of the rod of the jack V2, and E and F for the emergence and the return respectively of the telescopic element.

With the distributor there are associated microcontacts which permit detecting the existing movement or movements, two microcontacts being provided for each movement of the jacks V1 and V2 assuring the pivoting of the arms. These microcontacts are marked a1, a2 . . . d1, d2. A microcontact is provided to detect each of the movements E and F, these microcontacts being indicated as e and f respectively.

The microcontacts a1, b1, c1, d1 are combined in a single assembly to form a feed relay Rc abcd of the solenoid valve EVS.

As shown in the drawing, the microcontacts a1 and d1 on the one hand and b1 and c1 on the other hand are mounted in parallel in such a manner that upon the carrying out of a crosswise movement at the level of the jacks V1 and V2 the solenoid valve EVS is not fed.

In position under voltage and without awaiting the contacts RD.T2 and RD2.T1, which are closed and by the relay Rc abcd which is closed when there is no crossed movement A D, B C.

Upon placing in safety by the reaching of the first threshold, the pressure detectors 10 or 12 opens the contact of threshold 51 and disconnects the feed from the relay RD which, after a time delay, closes contacts RD.T1 and RD.1, opens contacts RD.2 and RD.T2 after a time delay, the time delay of RD.T2 being equal to that of RD.T1.

The solenoid valve EVS is no longer fed and the system is under safety.

If the operator effects easing movement, the contact of threshold 51 closes and again feeds the relay RD, which opens the contacts RD.1 and RD.T1 and removes the feed from the relay RD2. The contact RD.2 closes immediately; contact RD2.T2 is held closed for its time delay and the memory relays RAZRACM, RAZRBDM and RAZREM are fed.

The contact RD.T2 closes immediately. The relay RD2 being no longer fed, the contact RD2.T1 closes after a time delay and feeds solenoid EVS. The system is again operational.

The three relays RAZRACM, RAZRBDM and RAZREM in question are the relays for the erasure of the memory of the relays RACM, RDBM and REM. The memories of these three relays are intended to record and maintain stored until erasure, the movement which has resulted in the placing in default of this system by the reaching of the first threshold. The erasure of the memory will be attained only when RD is again under voltage, that is to say when the contact of threshold 51 is closed, the pressure being moved below a critical value.

The erasure relays of the memories RAZRBDM and RAZREM may likewise be fed by the contact RSI.1 upon the use of the second pressure threshold 52, the operation of which is explained below.

Upon the carrying out of a movement, A or C or A and C, that is to say a hoisting movement, several possibilities may arise:

The load is permissible and therefore RD is fed. The microcontacts a1 and/or c1 are closed, a2 and/or c2 are open. The line A2 not being under voltage, the closing of a1, c1 in no way changes the system and EVS is fed normally. Operation is possible. If one attempts to carry out the movements B or D at the same time, the relay Rc abcd opens, and the contacts a2, b2 open and remove the feed from solenoid EVS. All the movements are impossible although the value of the pressure is below the first threshold.

The load is inadmissible as from the start of the movement or becomes so during the course of operation. At the time of the appearance of the fault, after a time delay, the line A2 is fed, the microcontacts a1 and/or c1 are closed. Contacts REM3 and RE3 are closed and RBDM2 is closed since the fault has not appeared by a movement B or D and therefore has not been memorized in RBDM. The relay RACM places the appearance of default on A or C in the memory, and the relay RAC is fed. By the placing in default, contact RD.T2 opens, solenoid EVS is deenergized and the continuation of the operation is no longer possible. If the movement A or C is reproduced, there is no refeeding of solenoid EVS as contact RACM3 is open.

It is then necessary to contemplate the hypotheses of performance of the movements E, F or B, D.

If one attempts to execute E, the microswitch RE3 opens, since the relay RE is fed and it remains without effect on the feeding of solenoid EVS. The contact being closed on the feed of e, the relay RE being fed, the contacts RBDM3 and RBD are closed, RACM4 is open, since relay RACM has in its memory the default noted on movement A or C and relay REM is not fed. The contacts RE.1 and RE.2 which are normally closed are then opened. Solenoid EVS cannot be fed again and the system remains under safety.

If it is attempted to execute F, the contact f is closed. The line A2 is under voltage, the contacts RBD.1 and RAC.1 are normally closed since no movement is made on B, D nor on A, C. Only relay RACM retains in memory the appearance of the default on relay RAC. Solenoid EVS is fed again for the time that the operation takes and until it is interrupted or the contact of threshold 51 closes again. It is not possible to effect the movements B, D jointly at F as long as the joint execution of A, C opens the contact RAC.1 and prohibits the movements. This alternative is compulsory due to the fact that it is not known hydraulically what the priority movement will be and that A, C worsens the situation.

If one attempts to perform B, D the contacts b1, d1 close. The contact RACM2 is opened since relay RACM has in its memory the appearance of the default on A, C. Relays RBDM and RBD cannot be fed. The contact RACM.1 is closed as well as the contact REM.1. The solenoid valve EVS is again fed and the movements B, D will be made impossible. The combination with E is impossible since, in this case, the contact RE.1 would be opened.

If one attempts to execute crossed movements, B, D could again feed solenoid EVS but the crossed relay RC abcd opens and leaves the system under safety.

Upon the execution of a movement B, D or BD the two preceding hypotheses are to be contemplated and the system reacts in each case in the same manner but with the pilot relays RBD and RBDM.

The placing in default by the execution of the movement F is to be excluded since this movement is always relieving if it is executed alone.

Upon explaining the movement A, C it was indicated that the simultaneous execution of relieving movements B, D with F remains possible, but that the combination of F with the movement which has created the default becomes impossible.

If the movement E should place the system in default, the system is designed in such a manner that the effects of the movement E are assimilated to those of the movement B, D. It would also be possible to adopt the opposite possibility and assimilate them to A, C. Due to the hypothesis established, the placing in default upon the execution of the movement E makes the refeeding by movement B, D impossible. It is recalled that E is impossible when a dangerous threshold has been reached either by B, D or by A, C. The assimilation of B, D to E is necessary in order that, when one lowers a load, the point of application of which is located above the planes H1 and H2 and the first pressure threshold is reached by execution of the movement E, the continuation of the descent by B, D is prevented. Obviously, lifting by the movements A, C is still possible.

Several hypotheses must be contemplated:

The movement E is undertaken and its execution does not have the effect of causing the first pressure threshold to be cleared. The contact e closes. Now the line A2 is not fed and solenoid EVS remains fed, so that the movement takes place normally. The movements EBD and EAC remain possible, only one crossing EBC or EAD deenergizes EVS by opening the crossing relay Rc abcd.

The placing in default takes place when the point of application of the load P is located above the planes H1 and H2. The contact e closes, the line A2 is under voltage after the opening of the contact 51. As the contact RE3 prevents the crossing EAC, the relays RE and REM are fed and contacts REDM3, RBD and RACM4 are closed since there is no default on A C or B D. The relay RE opens the contacts RE.2 and RE.1, the relay REM opens the contact RME2, placing the second detected pressure threshold in operation, and the contact REM3 opens while RME.1 closes. No movement is therefore possible if the movement E has not been interrupted. When E is interrupted, the movement F is possible, contacts RED.1 and RAC.1 being closed. Although contact RE.1 is closed, the movements B, D are impossible since contact RACM.1 is open for nonfault on A, C.

The movements A, C are possible since contacts RE3, a, c, RME.1 and RE.2 are closed. The refeeding of solenoid EVS takes place and AC which kinematically is relieving, does not permit the contact 52 to open.

If the point of application of the load P is below the two horizontal planes H1 and H2, the operation of the system is the same with placing in operation of the second pressure threshold, prevention of movements B, D and authorization of A, C. The movement A, C takes place but its execution is aggravating and the pressure value detected will reach the second threshold. The contact 52 opens, relay RS1 is no longer fed and closes the contact RSI.1 which feeds the ratio relays of memories RAZRBDM and RAZREM and simultaneously feeds the relays RAC and RACM of the movements AC. The memories RBDM and REM being erased, REDM.1 and RME.1 are open, a default in memory on relay RACM and contact RACM.1 is closed. The movements B, D actually again feed solenoid EVS if they are not crossed with E.

This last safety system has numerous advantages, the main ones of which are as follows:

certainty is had that the safety system is in operating order;

initial safety is assured due to the impossibility of any hydraulic control movement including the rotation of the base and the movement of the stabilization props in the case of a crane mounted on a vehicle;

the use of one solenoid valve both for the circuit supervision system and as an apparatus for placing the apparatus under safety;

possibility of installation of such a system on numerous types of apparatus without modification of or addition to the basic structural elements;

possibility of eliminating locking jacks for the slide, as well as the solenoid valve feeding them and the different hydraulic or electric accessories;

possibility of mounting the solenoid valve at any point in the feed conduit of the distributor, which permits adaptation to any type of apparatus;

limitation of maintenance of the system since a solenoid valve is a very simple accessory.

I claim:

1. In a crane system comprising:

a hydraulically operated crane having:

a support, a first arm extending upwardly from said support, a second arm pivotally connected to said first arm at an upper end thereof, a first piston-and-cylinder arrangement hingedly connected to said first and second arms for varying an angle between them, a third arm pivotally connected to said second arm, a second piston-and-cylinder arrangement pivotally connected to said second and third arms for varying an angle between them, and a telescoping member on said third arm, extensible therefrom and adapted to support a load, said member being provided with hydraulic means for extending and retracting said member;

distributor valve means connected to said first and second piston-and-cylinder arrangements and to said hydraulic means for controlling the relative movements of said arms and said member to prevent overloading of the crane by limiting certain relative movements while permitting others, said distributor valve means including at least one distributor valve having a linearly shifting valve member; and circuit means including detectors establishing first and second pressure thresholds for said piston-and-cylinder arrangements for controlling said distributor valve means to establish the conditions under which said first and second piston-and-cylinder arrangements and said hydraulic means can be actuated after said thresholds are exceeded, the improvement which comprises:

means responsive to said detectors for shifting said valve member from either of two selected positions to either side of a central position, into said central position, said shifting means comprising:

a pair of stops formed in axially spaced relationship on said member, at least one actuator surrounding said member between said stops whereby said member can move relative to said actuator while said actuator is immobilized against one of said stops, and means for energizing said actuator to displace said actuator and thereby shift said member toward said neutral position.

2. The improvement defined in claim 1 wherein said actuator is a sleeve surrounding said valve member and said energizing means includes a solenoid coil for displacing said sleeve.

3. The improvement defined in claim 1 wherein said actuator is a piston surrounding said valve member and said energizing means includes means forming a cylinder receiving said piston and defining a pair of oppositely pressurizable chambers therewith.

4. The improvement defined in claim 1 wherein said distributor valve means is provided with a solenoid valve energized by said circuit, said valve member being constructed and arranged to selectively actuate a pair of switches connected in said circuit.

* * * * *